United States Patent [19]

Michalska et al.

[11] 4,331,198

[45] May 25, 1982

[54] ROTARY HEAT EXCHANGER

[75] Inventors: Tamara M. Michalska; Robert M. Stahl, both of Toledo, Ohio

[73] Assignee: Midland-Ross Corporation, Cleveland, Ohio

[21] Appl. No.: 101,454

[22] Filed: Dec. 10, 1979

[51] Int. Cl.[3] ..... F28D 19/00

[52] U.S. Cl. ..... 165/9; 165/10

[58] Field of Search ..... 165/10, 9; 55/390

[56] References Cited

U.S. PATENT DOCUMENTS

| | | | |
|---|---|---|---|
| 2,579,212 | 12/1951 | Stevens et al. | 165/9 X |
| 2,925,254 | 2/1960 | Ritz | 165/7 |
| 3,101,778 | 8/1963 | Hazzard et al. | 165/10 |
| 3,702,156 | 11/1972 | Rohrs et al. | 165/10 |
| 3,710,850 | 1/1973 | Kurschner et al. | 165/10 X |

FOREIGN PATENT DOCUMENTS

| | | | |
|---|---|---|---|
| 812491 | 4/1959 | United Kingdom | 165/10 |

*Primary Examiner*—Albert W. Davis

*Attorney, Agent, or Firm*—Richard A. Negin

[57] ABSTRACT

The present invention is a rotary heat exchanger core for use with a rotary heat exchanger. The core comprises a plurality of discs having passages for axial fluid flow. The discs are axially aligned and connected with a space between adjacent discs. There is a means to prevent circumferential fluid flow in the space between adjacent discs. Preferably the discs are connected in a moving relationship relative to each other to help compensate for thermal movements and dimensional changes resulting from thermal expansion and contraction.

8 Claims, 18 Drawing Figures

ROTARY HEAT EXCHANGER

BACKGROUND OF THE INVENTION

This invention is in the field of rotary heat exchangers; more particularly, the invention relates to a rotary heat exchanger core and seals for use in rotary heat exchangers.

Rotary heat exchangers are used to transfer heat from one fluid, such as a gas, to another. Rotary heat exchangers used to transfer heat between gas streams comprise a hot gas directing system, a cold gas directing system, a rotary heat exchanger core, and a means to rotate the core through the hot and cold gas directing systems, continually transferring heat from the hot gas stream to the cold gas stream. Rotary heat exchangers are used with hot and cold gas streams in applications such as turbines and industrial energy recovery systems. The rotating core of the rotary heat exchanger must be properly sealed so that there is no leakage between the hot and cold gas streams.

Generally, the rotary heat exchanger core comprises a central hub and a circumferential frame. There is a matrix of material between the hub and the frame through which the hot and cold gas streams pass as the core rotates. The matrix is designed to maximize the amount of heat which can be withdrawn from the hot gas stream and passed to the cold gas stream during rotation. The matrix is made of a grid of a heat resistant alloy metal which allows the passage of a gas. Rotary heat exchanger cores are also made of ceramic materials. The metallic and ceramic core matrix materials have large surface areas for fast heat transfer.

There are axial and radial flow rotary heat exchangers. In axial rotary heat exchangers, the gases pass axially through a cylindrically shaped rotary heat exchanger core. Cold gas flows axially through one portion of the core while hot gas flows countercurrently through another portion of the core. There are means to seal to prevent leakage between hot and cold gas streams. U.S. Pat. No. 4,105,062 shows the use of a leaf seal to prevent leakage. However, seals used commercially result in as much as ten percent leakage between the hot and cold gas streams.

Rotary heat exchangers with metallic alloy matrixes or ceramic matrixes are known in the art which are used to transfer heat from gases at temperatures as high as 1600° F. A continual problem with rotary heat exchangers particularly used at higher temperatures is thermal fatigue and thermal distortion. This results in warpage of metallic alloy cores and fatigue failures of ceramic cores initially resulting in leakage and finally failure of the core.

Rotary cores, as known in the art, are composed of one cylindrical unit. The core width can vary, as desired. The core diameter can be from about two feet to about twelve feet. Metallic cores are made of stainless steel. A typical stainless steel for high temperature metallic cores is 446 stainless steel having a nominal percent composition of 0.10 C, 1.00 Mn, 0.015 P, 0.015 S, 0.50 Si, 25 Cr, 0.70 (max) Ni, 0.15 $N_2$ and 73 Fe. The core can be composed of a grid of stainless steel plate having a desired thickness. Typically, the thickness between 0.005 and 0.002 inches with 0.002 inch plate is commonly used.

Various core designs are known in the art. Of interest is the suggestion in U.S. Pat. No. 3,162,241 of a matrix which may be a series of discs. This patent is concerned with rotary heat exchangers in which air passes radially through the matrix. Each disc in this arrangement would see the same thermal gradients. There is no suggestion of overcoming the problems of thermal distortion and dimension change between adjacent discs. Further, it is suggested that if the matrix is made of a series of discs, these discs are assembled in one cylindrical annular framework which is not itself separated into integral discs.

U.S. Pat. No. 3,367,404 discloses a rotary heat exchanger with a ceramic matrix made up of a plurality of discs cemented together. As in the above patent, this patent is directed towards a rotary heat exchanger where the gas passes radially through the matrix. The use of a plurality of discs in this ceramic matrix is directed toward a more economical method of production of the matrices.

Generally, the problems of leakage and warpage resulting from thermal fatigue and thermal distortion are recognized in the art and attempts are continually made to minimize or eliminate these problems. The present invention is an improved rotary heat exchanger core which minimizes or eliminates these problems.

SUMMARY OF THE INVENTION

The present invention is a rotary heat exchanger core for use with a rotary heat exchanger. The core comprises a plurality of discs having passages for axial fluid flow. The discs are axially aligned and connected with a space between adjacent discs. There is a means to prevent circumferential fluid flow in the space between adjacent discs. Preferably, the discs are connected in a moving relationship relative to each other to help compensate for thermal movements and dimensional changes resulting from thermal expansion and contraction.

It is generally the object of the present invention to provide a new and improved rotary heat exchanger core for use in a rotary heat exchanger, to transfer heat between fluids, particularly gas, passing through a rotary heat exchanger. More specifically, it is the object of the present invention to make a rotary heat exchanger core from a plurality of discs so as to minimize thermal distortion and warpage in the core. A feature of this invention is to be able to make any one of the several discs of different materials depending on the conditions to which it is exposed. It is a further object of the invention to minimize circumferential leakage between hot and cold gas streams in the space between the discs. More particularly, it is an object of the present invention to minimize circumferential leakage between the hot and cold fluids by the use of sealing bars connected between the radial faces of adjacent discs. The sealing bars allow for thermal expansion and contraction of discs relative to each other while maintaining the seal.

It is an object of the present invention to provide an improved type rotary heat exchanger core for industrial furnace applications in large capacity operations where the flue temperatures are 1500° F. and greater. It is another object of the present invention to provide a rotary heat exchanger core which will result in a heat transfer efficiency of eighty to eighty-five percent. It is a further indirect object of the present invention to overcome problems of wearing out of pressure seals due to thermal expansion in existing heat wheels.

It is an object of this invention to obtain one or more of the objects set forth above. These and other objects and advantages of this invention will become apparent to those skilled in the art from the following specification and claims, reference being had to the attached drawings.

BRIEF DESCRIPTION OF THE DRAWINGS

Corresponding elements in different drawings have corresponding reference characters.

DESCRIPTION OF THE PREFERRED EMBODIMENTS

Figure 1:
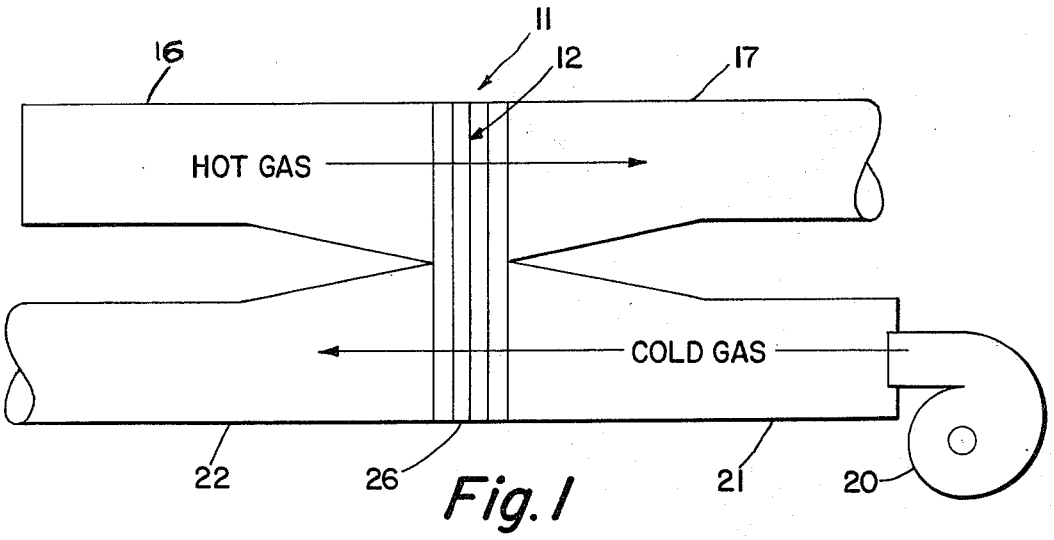
FIG. 1 is a schematic view of the rotary heat exchanger with the core in place between hot and cold gas ducts.

The present invention will be understood by those skilled in the art by having reference to the above listed figures. FIG. 1 is a schematic view of a rotary heat exchanger 11 containing a rotary heat exchanger core 12 of the present invention. The rotary heat exchanger core is designed for use in axial flow-type rotary heat exchangers. The core 12 comprises a plurality of discs 26 having passages for axial fluid flow. The discs are axially aligned and connected with a space between adjacent discs. There is a means to prevent circumferential fluid flow in the space between adjacent discs. Preferably, the discs are connected in a moving relationship relative to each other to help compensate for thermal movements and dimensional changes resulting from thermal expansion and contraction. A suitable means can be used to connect the discs and prevent circumferential fluid flow in the space between adjacent discs. A separate means can be used to connect the discs such as an axle passing through a hub opening in the center of each disc. The discs can be slidably mounted on the axle to allow for thermal movement and dimensional changes. The present invention will be described with reference to heat exchange between hot and cold gas streams although the application to heat exchange between other fluids using the concept of the present invention can be accomplished by those skilled in the art.

Hot gas is fed through hot gas intake duct 16, through the rotary heat exchanger core 12 and out of hot gas outtake duct 17. Cold gas flows countercurrent to the hot gas from a suitable cold gas source such as blower 20 through cold gas intake duct 21, through the rotary heat exchanger core 12 and out of cold gas outtake duct 22. There are sealing means to prevent leakage between hot and cold gas streams.

Figure 2:
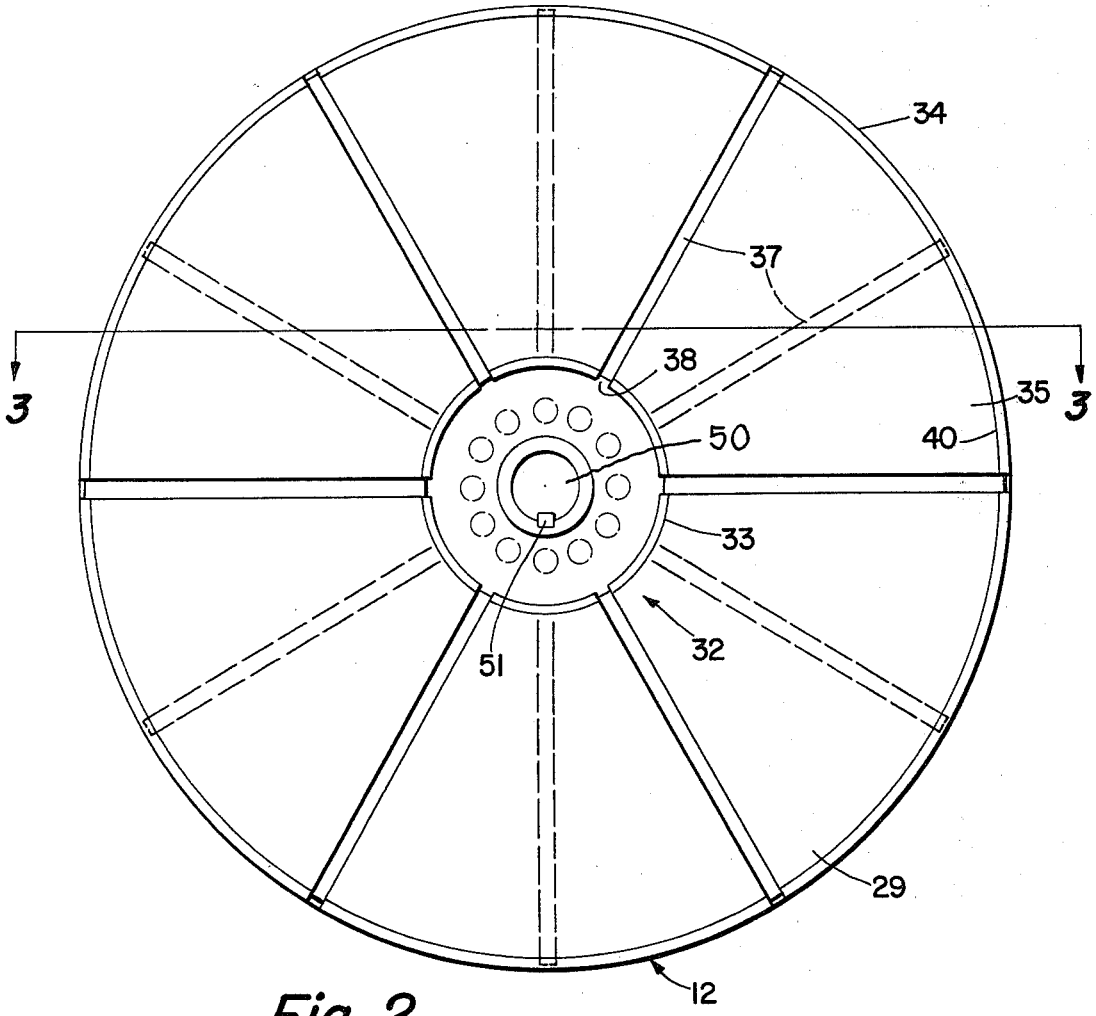
FIG. 2 is a view of the radial face of the rotary heat exchanger core of the present invention.
Figure 3:
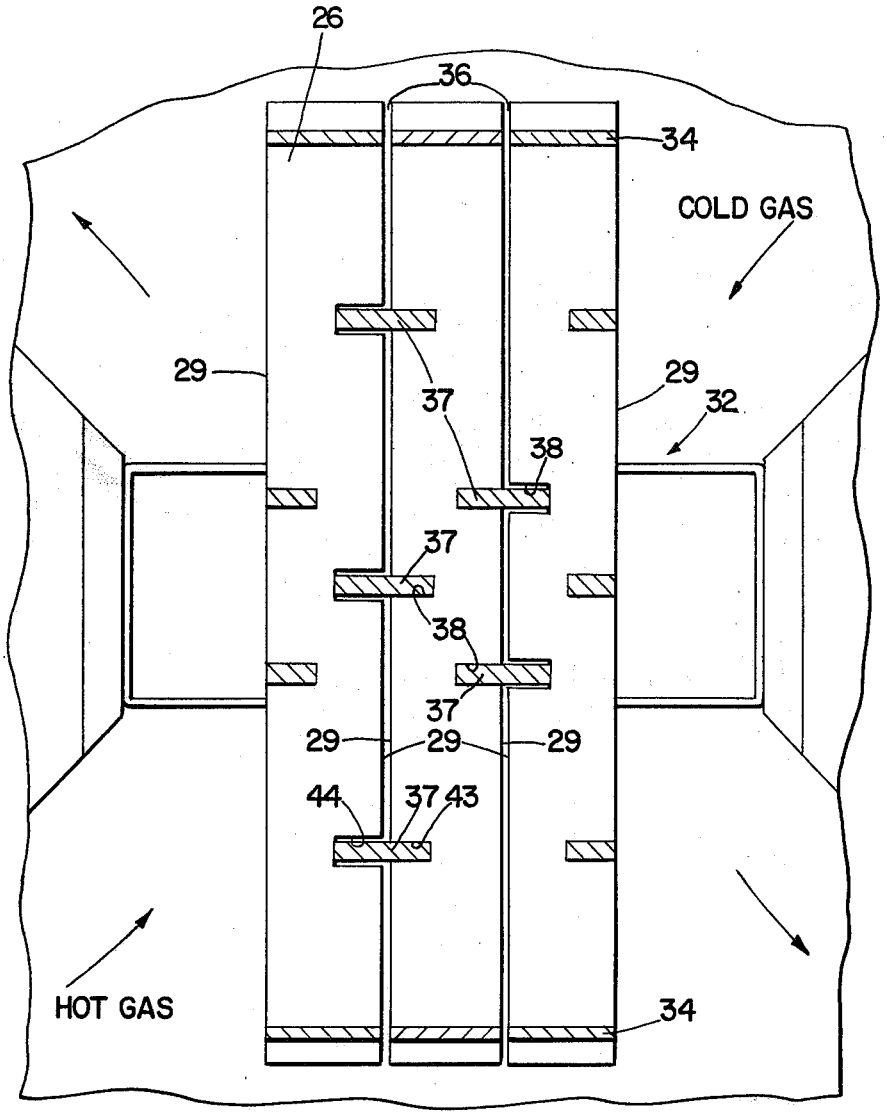
FIG. 3 is a partial sectional view of the rotary heat exchanger shown in FIG. 2 along lines 3—3.

FIGS. 2 and 3 illustrate a preferred embodiment of the rotary heat exchanger core of the present invention. The core 12 comprises a plurality of discs 26. Each disc 26 has two radial faces 29, a radial face and an opposite radial face. Each disc further comprises an inner hub means, generally shown at 32, being coaxial with the axis of the rotary heat exchanger core 12. The type of hub design used is not a limiting factor in the present invention. The hub 32 shown in FIG. 2 has an outer cylindrical hub surface 33. The axial center of cylindrical hub surface 33 corresponds to the center of the rotary heat exchanger core 12. There is an outer frame means being coaxial with the axis of the rotary heat exchanger core 12. The frame means can be a band metal, such as frame band 34, around the outer circumference of rotary heat exchanger core 12. The width of the frame band is preferably, although not necessarily, equal to the width of the disc 26. There is packing 35 between the hub surface 33, the frame band 34 and the radial faces 29 of each disc 26. This packing can be any type of packing used in rotary heat exchanger cores which are known in the art. Preferably, the packing 35 is composed of thin sheets of metal which is corrugated and has passages so that gas may pass axially through the discs. Although the flow in the packing of a disc is not necessarily parallel to the axis of the disc, gas flow is considered axial if the flow into and out of the radial faces of a disc is axial. The packing can be designed to prevent circumferential flow of the gas within the disc as the gas passes through the discs 26.

There are spaces 36 between adjacent discs 26 which comprise the core 12. A plurality of sealing means extend from the hub means to the frame means in the space 36. Each sealing means has two opposite longitudinal edges, one edge and an opposite edge. Each one edge extends into a channel in the radial face, the channel extending from the hub means to the frame means. Each opposite edge extends into a channel in the opposite radial face of an adjacent disc, the channel in the opposite radial face extending from the hub means to the frame means. The channel is equal to or slightly wider than the portion of the sealing means which extends into it. Thereby, the sealing means substantially prevents circumferential fluid flow in the space between the radial face of adjacent discs. There can be suitable clearance at the base of the channels to compensate for dimensional changes of the sealing means during heat exchanger operation. Cores for rotary heat exchangers known in the art have spoke means connecting the hub means to the frame means for structural support. The sealing means of the present invention can be used in place of or in addition to such spoke means.

Figure 4:
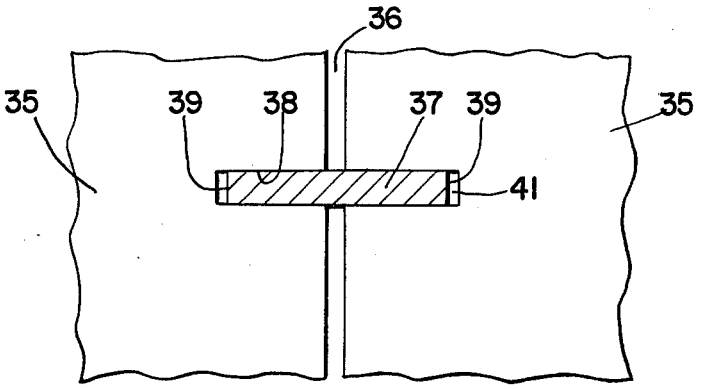
FIG. 4 is a sectional view of a sealing bar between adjacent discs with clearance at both ends of the bar.

A preferred embodiment of the present invention is shown in FIGS. 2, 3 and 4. The sealing means is one of a plurality of sealing bars 37. The sealing bar 37 preferably is rectangular in cross-section and has two opposite longitudinal edges 39, one edge and an opposite edge. Each disc 26 has a plurality of channels 38 extending from at least to the hub surface 33 to at least the inner frame surface 40. Preferably, the channels 38 are radial and extend into the hub surface 33 and into the frame surface as shown in FIG. 2, although it is only necessary for the channels 38 to extend to the surface hub 33 and to the frame surface 40.

The channels 38 are equal to or only slightly wider than the width of the sealing 37. One edge 38 of each sealing bar 37 is pressed into each corresponding channel 38 of one radial face 29 of each disc 26. The opposite radial face of the adjacent disc 29 has corresponding channels 38 which are equal to or slightly wider than the width of the opposite edge of each corresponding sealing bar 37 which the corresponding channel is adapted to receive. In order to make assembly easier, the one radial face can have narrow channels 43 with little or no clearance for the one edge of the sealing bar 37 and the opposite radial face of the adjacent disc can have slightly wider channels 44 than the width of the opposite edge of the sealing bar. However, the wider channel is only sightly wider so that upon heating the core 12 to operating temperatures there is a tight fit between the opposite edge 39 of sealing bar 37 and the wider channel 44.

Upon assembly of the core 12, there is a clearance 41 at the base of the channels 38 to compensate for dimensional changes during thermal expansion. There is sufficient space 36 between discs 26 and sufficient clearance 41 to allow for dimensional changes during thermal expansion with a minimum of internal stress and thermal warpage. There can be four or more sealing bars 37 between adjacent discs 26 with as many sealing bars 37 as practical. Preferably, there are between six and twelve sealing bars 37 between adjacent discs 26, with six shown in FIG. 2. When using the sealing bars as shown in FIGS. 2 and 3, the sealing bars 37 can extend from the hub to the frame and are interconnected or fastened as necessary to act as structural spokes making separate spokes unnecessary. Of course, spokes can be used in addition to the sealing bars. The sealing bars can be made of any suitable material which can withstand the operating temperatures and have desired structural properties if the sealing bars 37 are designed to act as spokes in addition to being a sealing means. Depending on conditions, sealing bars can be made from silica carbide, carbon steel or stainless steel. The dimensions of the sealing bar will vary with the core size, the number of sealing bars, the material of the sealing bar and the conditions which the sealing bars are exposed to. An example of a typical size of cross sectional dimension for a stainless steel bar is about $\frac{1}{2}$ inch by about $2\frac{1}{2}$ inches for a disc 26 which is about 3 inches wide. This is only an example and is not extended to limit the scope of the invention.

Figure 5:
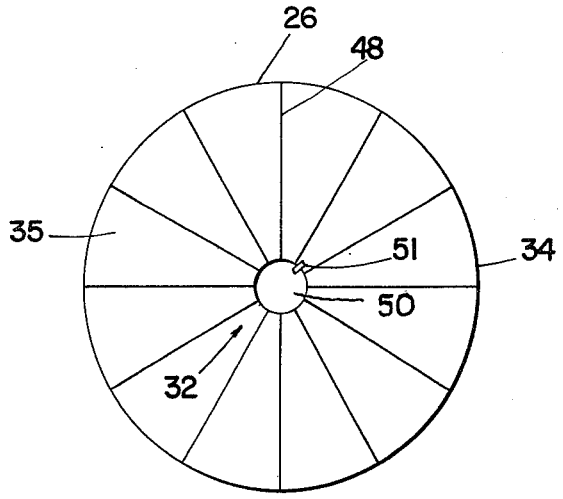
FIG. 5 is a view of the radial face of an alternate embodiment of the rotary heat exchanger core of the present invention.
Figure 6:
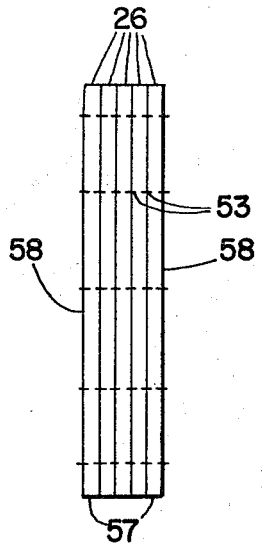
FIG. 6 is a side view of FIG. 5.

FIGS. 5 and 6 show an alternate embodiment of rotary heat exchanger core 12 comprising a plurality of discs 26. Each disc 26 has a hub means such as hub 32, a frame means such as frame band 34 and a packing 35 between the hub 32 and the frame band 34. In the discs of this embodiment, a plurality of spoke means such as spokes 48 connect the hub 32 to the frame band 34 and are in at least one radial face of each disc 26. Spokes 48 connect the frame means and makes the core rigid. The hubs 32 of the plurality of discs 26 are preferably coaxial. A suitable means can be used to rotate the core 12 comprising the plurality of discs 26 which are aligned coaxially on an axle means such as axle 50 and rotate with the rotation of axle 50 by use of a suitable locking means such as key 51.

Figure 8:
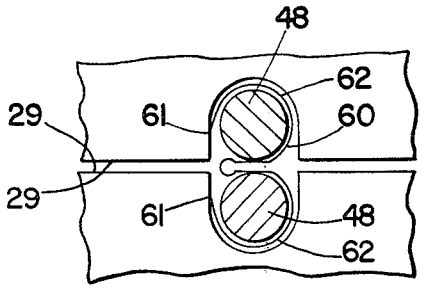
FIG. 8 is a sectional view of the sealing plate of FIG. 4 connecting the spokes of adjacent discs.
Figure 9:
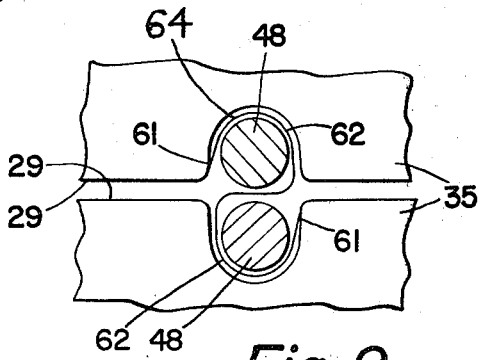
FIG. 9 is a sectional view of a sealing plate in the shape of the letter "S" connecting the spokes of adjacent discs.
Figure 10:
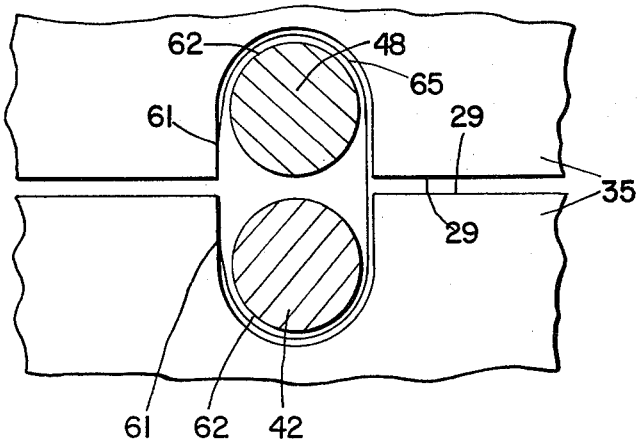
FIG. 10 is a sectional view of a sealing plate in the shape of the letter "C" connecting the spokes of adjacent discs.

As shown in FIGS. 8, 9 and 10, the spokes 48 are preferably in spoke channels 55 in the packing 35 of the radial faces 29. The spokes 48 in adjacent radial faces 29 are in approximately corresponding locations so that corresponding spokes 48 can be connected by means to connect 53. Preferably, the spokes 48 extend radially from the hub 32 to the frame band 34. Spokes 48 are not necessary in the outside radial face 58 of outside discs 57. In this embodiment there can be four or more means to connect 53 spokes 48 in adjacent radial faces 29. Preferably, there are six to twelve means to connect 53 spokes in adjacent radial faces 29, with twelve shown in FIGS. 5 and 6. The diameter of the spokes can vary with the size of the wheel, the operating conditions and the number of spokes. An example stainless steel spoke can be $\frac{3}{8}$ inch to $\frac{1}{2}$ inch in diameter in a core containing about twelve spokes in each face. This example is for illustrative purposes and is not intended to limit the spoke size or number of spokes which can be used.

FIG. 6 shows a core which comprises five coaxial discs 26 with means to connect 53 connecting corresponding spokes 48 in adjacent discs 26. The means to connect 53 bridges the space between adjacent discs to prevent circumferential fluid flow in the space between the radial faces 29. The means to connect the spokes can be variable in the axial direction, with respect to the cores 12, to help compensate for thermal dimensional changes. Preferably, the means to connect the spokes 48 are flexible in the axial direction.

Embodiments of flexible means to connect 53 such as flexible sealing plates are shown in FIGS. 7 through 10. Sealing plates like the sealing bars are a means to seal extending from the hub means to the frame means and prevents circumferential flow in the space 36 between adjacent radial faces 29. Sealing plates, examples of which are described below, are made of a flexible material and have means to be connected to corresponding spokes 48 in adjacent radial faces 29. The sealing plates extending from the hub to the frame means are shaped at opposite longitudinal edges to fit about corresponding spokes in the radial faces 29 of adjacent discs 26. Each sealing plate has a portion of each opposite longitudinal edge such as an open edge or surface pressing against each corresponding adjacent disc which it is connecting from the hub means to the frame means. The sealing plate provides a means to connect adjacent discs and at the same time provides a seal against circumferential flow in the space between adjacent discs.

Figure 7:
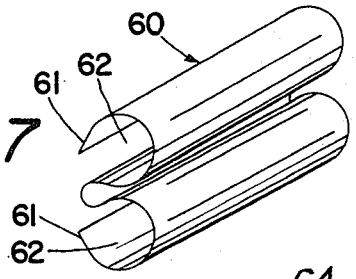
FIG. 7 is a view in perspective of a flexible sealing plate in the shape of the number "3" which can be used with the rotary heat exchanger core of FIG. 6.

FIG. 7 shows a sealing plate generally in the shape of the number "3" reference character 60. FIG. 8 shows a cross sectional view of sealing plate "3" reference character 60 connecting the spokes 48 of adjacent discs 26. The circular loops 62 of the number "3" are used to enclose corresponding spokes 48 in adjacent discs. The open ends 61 of the "3" extend from the hub 32 to the frame 34 and provide the seal which prevents circumferential fluid flow in the space between adjacent disc radial faces. Another embodiment of a flexible sealing plate used to connect corresponding cylindrically shaped spokes 48 in adjacent discs is an "S" shaped sealing plate reference character 64 shown in place in FIG. 9 and a flexible sealing plate in the shape of a "C" reference character 65 shown in FIG. 10. The open ends 61 of the "S" and the "C" seal in a similar way as the open ends 61 of the "3". Cylindrically shaped spokes 48 with circular shaped loops 62 are used for illustrative purposes. Other suitable flexible sealing plate designs can be used which correspond to the shape of the corresponding spokes in adjacent discs.

Figure 11:
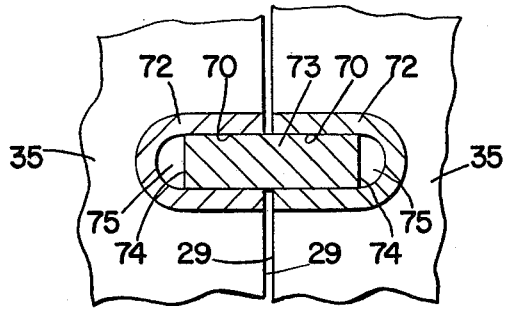
FIG. 11 is a sectional view of an alternate embodiment of the present invention having a sealing means between rectangular spokes with rounded ends.
Figure 12:
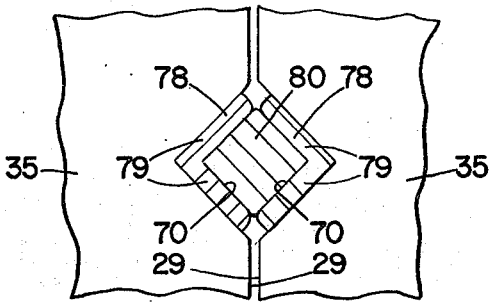
FIG. 12 is an alternate embodiment of the sealing means of FIG. 11 where the spokes are at right angles.
Figure 13:
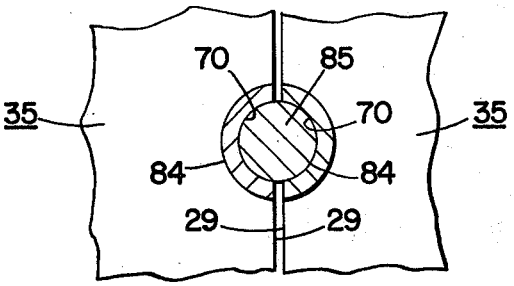
FIG. 13 is an alternate embodiment of the sealing means of FIG. 11 where the spokes are semicircles.

Alternate embodiments of the sealing means are shown in FIGS. 11, 12 and 13. In these embodiments trough spoke means are provided which extend at least from the hub means to at least the frame means. The trough spoke means are shaped to provide a spoke channel 70 in the radial faces 29 of the discs 26. The sealing means are trough sealing means located between adjacent disc faces with opposite longitudinal edges or sides extending into corresponding channels 70 of adjacent radial faces 29. The sealing means extend from the hub means to the frame means. The cross sectional shape and size of the trough sealing means is designed so that upon being heated to operating temperatures the opposite edges press against the spoke channels substantially sealing circumferential gas flow in the space between adjacent discs. The trough sealing means can be a trough sealing bar means made of suitable high temperature sealing material such as silica carbide.

FIG. 11 shows a "U" shaped spoke 72 with spoke channel 70 being the trough of the "U". A rectangular trough sealing bar 73 is located between the faces 29 of adjacent discs 26 having the opposite longitudinal edges 74 in the trough of the corresponding "U" shaped spoke 72. There is a clearance 75 at the base of the trough of the U to allow movement of the discs 26 relative to one another in a manner similar to the embodiment shown in FIG. 4. The width of the rectangular sealing bar is equal or slightly less than the distance between the legs of the "U".

FIG. 12 shows angle shaped spokes 78 with spoke channel 70 being toward the crotch of the angle. The arms 79 of the angle shaped spokes are equal and a rhombus sealing bar 80 is located between adjacent radial faces 29 having two opposite corners with angles equal to the angle of the spoke 78. Preferably the spoke angle is a right angle and the rhomboid sealing bar 80 has a square cross section. The rhombus bar is sized so that there is a clearance space between the sealing bar 80 and the spokes 78 when the core 12 is cold. As the core 12 heats up the expansion of the various components, i.e. the disc, the spokes and the sealing bar relative to one another cause the clearance to decrease or be eliminated, thereby providing a seal which prevents circumferential gas flow in the space 36 between adjacent disc radial faces 29.

The embodiment shown in FIG. 13 is similar to that of FIG. 12 except that the spokes 84 are semicircle shaped with channel 70 being the open semicircle. A circular sealing bar 85 is used similarly to the rhomboid sealing bar 80 of FIG. 12. The embodiments of FIGS. 12 and 13 may result in leakage, particularly when operating at lower temperatures than they were designed for. As with the embodiments shown in FIGS. 2 and 5, the embodiments of FIGS. 11, 12 or 13 have four or more means to connect in a core 12, with six to twelve preferred.

Each disc 26 is preferably two to five inches wide, although the width can vary to accomodate design calculations. The hub means, frame means, and matrix are made of metal or metal alloy. However, the discs 26 within a given core 12 can be made of the same or different material. High quality alloy can be used in discs going from the cooler end to the hotter end of the rotary heat exchanger core 12. By using different material, thermal expansion effects can be minimized. Rotary heat exchanger cores are presently made of stainless steel, such as 446 stainless steel. A typical 446 stainless steel is Rolled Alloys, Inc. RA446 which has a nominal percent composition of 0.10 C, 1.00 Mn, 0.015 P, 0.015 S, 0.50 Si, 25 Cr, 0.70 max Ni, 0.15 $N_2$ and 73 Fe. Using the rotary heat exchanger core of the present invention discs with a core exposed to higher temperatures can be made of high quality stainless steel such as 330 stainless steel. An example of a higher quality stainless steel is Rolled Alloys, Inc. RA330 which has a nominal percent composition of 0.05 C, 1.50 Mn, 0.015 P, 0.015 S, 1.25 Si, 19 Cr, 35 Ni, 43 Fe. The discs exposed to lower temperatures can use lower quality stainless steel, such as 330 stainless steel or lower quality stainless steel. Depending on the conditions, discs at very low operating conditions can be made of carbon steel. In this way the core of the present invention can take advantage of the better properties of more expensive materials only where they are needed. This results in a better quality core with a longer life for less cost.

One possible application for the present invention is to recover heat from flue gases from steel reheat furnaces. A rotary heat exchanger as described in this invention can be used on new installations or retrofit into existing installations. Presently, recuperators employed in steel reheat furnaces require air dilution to prevent temperatures from becoming greater than 600°–900° F. There is a need for a compact, high efficient heat recovery system which can recover heat from flue gases in a temperature range of 1500°-1800° F. As discussed in the background rotary heat exchangers known in the art have problems of leakage and cross contamination through seals, fouling and corrosion from flue gases and problems with high temperature thermal fatigue and warpage. Based on this environment, theoretical calculations have been made to show the rotary heat exchanger containing the core 12 of the present invention will perform satisfactorily.

Heat transfer calculations on a rotary heat exchanger core substantiates the feasibility of the advance in the art of using a plurality of discs as a rotary heat exchanger core. The calculations show that temperature gradient in the axial direction is relatively high and the temperature gradient in radial planes is relatively low. Therefore, by using a plurality of discs, the axial temperature in any one disc is less than the axial temperature gradient of the whole core. This reduces thermal stress and distortion, particularly where the material and design of any one disc can be tailored for the conditions to which the disc is exposed. Further, the fact that the temperature gradient in any radial face is relatively low shows that discs can be used with a minimum of thermal stress and distortion in the radial direction.

Figure 14:
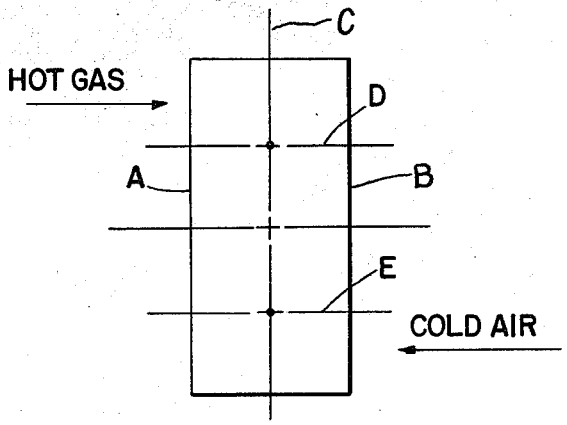
FIG. 14 is a schematic side view of a radical heat exchanger core showing gas flow and calculation reference characters.

Calculations made at a steady state results in temperature gradients in the core which result in little or no thermal movement in any of the discs which comprise the heat exchanger core of the present invention. The calculations were made for a one piece, cylindrical heat exchanger core 27 inches long, ten feet in diameter and made of steel. FIG. 14 is a sectional view of the core used in the calculations. Cold gas, air used in the calculation, flows countercurrently to hot gas, flue-type gas. Hot gas enters face A at 1500° F. and cold air enters face B at 100° F. The flow rate of both hot and cold gases is 10,500 standard cubic feet per minute with a velocity of 800 feet per minute.

The nominal coefficient of convection, $h_c$, for the cold air used is 4.5 Btu/hr-ft$^2$°F. and for the hot gas is 5.6 Btu/hr$^2$°F. The $h_c$ actually varies through the core in the axial direction. In terms of Btu/hr-ft$^2$°F. the $h_c$ of air used is 3.2 at face B, 4.4 at face C and 5.6 at face A, and the $H_c$ of hot gas used is 6.8 at face A, 5.6 at face C and 5.6 at face B in calculations 1 and 2 of Table I. In calculation 4, $h_c$ for air at face C is 4.6 and the $h_c$ for gas at face C is 5.9. The $h_c$ at faces A and C in calculation 3 is the same as calculation 1 except that $h_c$ in face A is 5.8.

A heat balance between the cold air and hot gas results in the hot gas leaving face B at about 550° F. and the air leaving face A at about 1100° F. The hot gas and air temperatures through the core are assumed to change linearly, although a slight variation is actually expected, and the efficiency is assumed to be 71%. The temperature of the flue gas in center plane C at its intersection with radially centered lines D in the flue gas passage is 1025° F., and the temperature of the air in center plane C at its intersection with the radial center line E in the air passage is 600° F. Table I below, shows the results of changes in the packing geometry and changes in revolutions per minute of the core. Temperatures and delta (Δ) T values are in degrees Fahrenheit. The temperatures are indicated as $T_{XY}$ with X being the radial plane and Y being the line intersecting the radial plane, reference being had to FIG. 14. For example, $T_{AD}$ refers to the temperature in radial plane A at a point where it is intersected by line D. Temperature differences are indicated as $\Delta T_Z$. For example $\Delta T_A$ is the temperature difference in radial plane A between $T_{AD}$ and $T_{AE}$.

TABLE I

| | Calc 1 | Calc 2 | Calc 3 | Calc 4 |
|---|---|---|---|---|
| Mesh Packing Thickness (In) | 0.01 | 0.01 | 0.01 | 0.016 |
| Open Area (%) | 77 | 77 | 77 | 66 |
| Open Area/Hole In$^2$ | .0079 | .0079 | .0079 | .0077 |
| Surface Area $\frac{In^2}{In^3}$ | 36 | 36 | 36 | 32 |
| Holes/In$^2$ | 96 | 96 | 96 | 86 |
| Equiv. Hole Dia | .101 | .101 | .101 | .099 |
| Total Solid Vol Ft$^3$ | 19.31 | 19.31 | 19.31 | 28.54 |
| Total Heating Area Ft$^2$ | 36265 | 36265 | 36265 | 32235 |
| Total Effective Flow Area Ft$^2$ | 28.72 | 28.72 | 28.72 | 24.62 |
| Rpm | 4 | 2 | 8 | 4 |
| $T_{AD}$ | 1361 | 1399 | 1339 | — |
| $T_{AE}$ | 1275 | 1234 | 1295 | — |
| $T_{CD}$ | 875 | 967 | 873 | 860 |
| $T_{CE}$ | 800 | 764 | 833 | 813 |
| $T_{BD}$ | 394 | — | — | — |
| $T_{BE}$ | 336 | — | — | — |
| $\Delta T_A$ | 86 | 165 | 44 | — |
| $\Delta T_B$ | 58 | — | — | — |
| $\Delta T_C$ | 75 | 143 | 40 | 47 |

A review of the results in Table I shows that increasing the packing thickness 60% to 0.016 inches causes the $T_C$ or temperature difference within the center radial plane to decrease to 47° F. The radial plane having the greatest temperature difference is plane A, the plane of introduction of hot gas.

For any given calculation, the ΔT values were relatively low, particularly in runs at greater than 2 rpm. The low ΔT values indicate that there is no problem of thermal distortion and stress in the radial planes of the core. Therefore, the use of discs does not present a problem of thermal distortion from the ΔT values. In fact, the use of a plurality of discs helps to eliminate stress caused by changes in ΔT values in radial planes along the length of a longer single piece core.

The temperature gradient in the axial direction is in the range of about 900° F. to about 1000° F. Such a large temperature gradient within a single piece core results in thermal stress and distortion. The use of a plurality of discs in place of a single piece core results in a smaller axial temperature gradient with each disc. Additionally, by using a plurality of discs, the material and design of any disc can be particularly tailored to the conditions to which it is exposed. The use of a core comprising a plurality of discs minimizes thermal stress and distortion resulting from axial temperature gradients.

For a given core geometry and constant air and hot gas flow conditions, the core speed (rpm) may be chosen within a wide range not affecting the system thermal efficiency. For a wheel geometry and flow conditions in the above, the theoretical limits are between 1 and 200 rpm. At 1 rpm the residence time in a hot or cold stream is 30 seconds. The hot gas stream residence time for the core to be heated up to its average temperature sets the lower limit for rpm selection. At 200 rpm the core residence time in a hot or cold stream approaches the same time required for fluid to pass through the length of the core. This is the upper limit. The guide for selecting core speed should be the information on temperature fluctuation within the core. Of course, changing the core geometry or flow conditons will affect the system thermal effectiveness.

In addition to the sealing means for use between the radial faces 29 of adjacent discs 26, the rotary heat exchanger core 12 can have circumferential edge sealing means. Circumferential edge sealing means, such as sealing plates, are shown in FIGS. 15 through 18. The circumferential edge sealing means, to prevent leakage of gases radially from the space 36 between radial faces 29 of adjacent discs through the circumferential gap 90 between adjacent discs.

Figure 15:
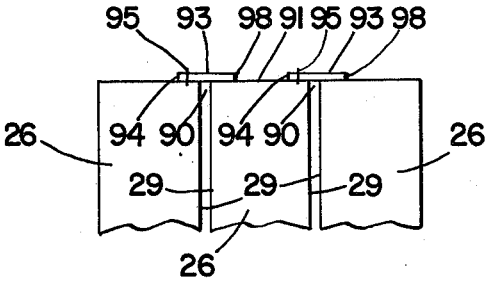
FIG. 15 is a sectional view of the core with a circumferential flat sealing plate.

FIG. 15 shows a sectional view of edge sealing plate 93 having a flat cross section. The edge sealing plate 93 is secured at one securable sealing plate edge 94 to the circumferential surface 91 of one disc 26 and overlaps at least one gap 90. The unsecurable edge 94 is close to or touches the circumferential surface 91 over which it projects. Any suitable means to secure 95, such as rivots, welds or screws can be used to secure sealing plate edge 94 to edge 95.

Figure 16:
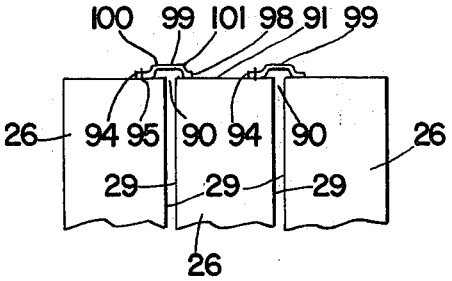
FIG. 16 is a sectional view of the core with a circumferential spring sealing plate.
Figure 17:
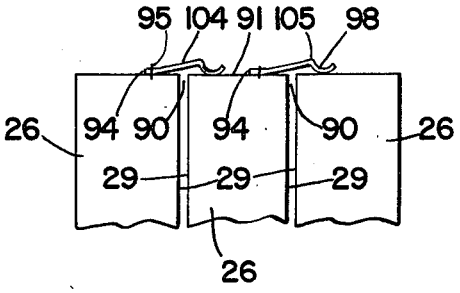
FIG. 17 is an alternate embodiment of the sealing plate of FIG. 18.
Figure 18:
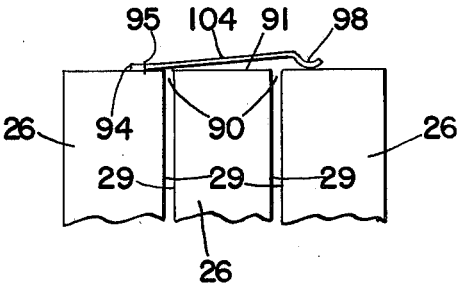
FIG. 18 is an alternate embodiment of the sealing plate of FIG. 17 sealing the circumferential gaps between three discs.

FIGS. 16, 17 and 18 are alternate embodiments of edge sealing plates. These embodiments incorporate a spring means to force the unsecurable edge 98 against the circumferential surface 91 of the disc 26 over which the unsecurable edge 98 projects. This is accomplished by designing the sealing plate so that in a neutral position the unsecurable edge 98 has a smaller radius, as related to the core 12 axis, than the securable edge 94, i.e. in a neutral position the unsecured edge would tend to be below the circumferential surface.

FIG. 16 shows a two legged edge sealing plate 99 having a shorter first leg 100 and a longer second leg 101. When mounted as shown, unsecurable edge 98 is forced against the circumferential surface 91 over which it projects. The relative length of the legs depends on the sealing plate material and expected thermal distortion.

FIG. 17 shows a one angle sealing plate 104 which is similar to the two legged sealing plate 99. Here the angle and length from the angle 105 to unsecurable edge 98 are designed so that unsecured edge 98 is forced against the circumferential surface 91 over which it projects.

FIG. 18 shows a one angle sealing plate 104 projecting over two circumferential gaps 90. The unsecurable edge 98 presses against the circumferential surface 91 over which it projects. Any of the above sealing plate embodiments can be used to seal at least one circumferential gap independent of the relative movement between the individual discs which make up the core 12.

Modifications, changes, and improvements to the preferred forms of the invention herein disclosed, described and illustrated may occur to those skilled in the art who come to understand the principles and precepts thereof. Accordingly, the scope of the patent to be issued herein should not be limited to the particular embodiments of the invention set forth herein, but rather should be limited by the advance which the invention has promoted the art.

What is claimed is:

1. A rotary heat exchanger, comprising:

(a) a plurality of coaxially aligned discs mounted in spaced relation along a common center axis around which the discs rotate, the discs each being integral and unsegmented and having passages through which fluid can flow in a direction generally parallel to the center axis;

(b) means coacting with the discs for sealingly dividing the space between each pair of adjacent discs into a plurality of generally pie-shaped areas which are sealed from each other such that fluid in one area cannot pass into an adjacent area, the means including, (I) a plurality of pairs of radially oriented and aligned channels in confronting faces of each pair of adjacent discs, and (II) sealing means extending across and into each pair of said pairs of radially oriented channels to seal the spaces between the channels while allowing limited relative movement between adjacent discs caused by thermal expansion or contraction of the discs; and (c) means for simultaneously circulating through different areas of the discs, two separated fluids at substantially different temperatures.

2. The core of the claim 1, wherein the means includes, a plurality of pairs of radially oriented and aligned channels in confronting faces of each pair of adjacent discs, and sealing means extending across and into each pair of said pairs of radially oriented channels to seal the spaces between the channels while allowing limited relative movement between adjacent discs caused by thermal expansion or contraction of the disc.

3. The heat exchanger of claim 1, wherein the sealing means includes, a metal lining in each of the channels, and a bar matingly configured to extend across and fit into the linings of each pair of radially aligned channels.

4. The heat exchanger of claim 3, wherein the bars have a cross section of the group of rectangular, circular and oval cross sections.

5. The heat exchanger of claim 1, wherein the sealing means includes, (I) a specially configured metal plate extending across and into each pair of radially aligned channels, each metal plate having a pair of opposing marginal edges which compressively sealingly engage adjacent sides of the channel, and a bar receiving recess adjacent each marginal edge; and )II) an elongated bar positioned in each recess.

6. The heat exchanger of claim 1, which includes, centrally aligned openings in the discs, an axle passing through the openings, and means for keying the discs to the axle for unitary rotation with the axle.

7. The heat exchanger 1, 3, 5, or 6, wherein each disc includes packing material with axial fluid passages.

8. The heat exchanger 1, 3, 5, or 6, wherein the means includes means on the generally cylindrical outer periphery of the discs for sealing the spaces between adjacent discs adjacent the outer periphery while allowing relative movement of the discs caused by thermal expansion and contraction of the disc.

* * * * *